United States Patent [19]

Klingelhoefer et al.

[11] Patent Number: 4,467,722

[45] Date of Patent: Aug. 28, 1984

[54] METHOD AND APPARATUS FOR DRAWING FLEXIBLE PRINTING BLOCKS ONTO PRINTING ROLLERS IN AN IN REGISTER MANNER

[75] Inventors: Hannsgeorg Klingelhoefer, Nuertingen; Klaus-Peter Rudolph, Stuttgart, both of Fed. Rep. of Germany

[73] Assignee: Bielomatik Leuze GmbH & Co.

[21] Appl. No.: 495,638

[22] Filed: May 18, 1983

[30] Foreign Application Priority Data

Jun. 4, 1982 [DE] Fed. Rep. of Germany ..... 3221066

[51] Int. Cl.[3] ..... B41F 27/00

[52] U.S. Cl. ..... 101/426; 101/389; 101/415.1; 101/383

[58] Field of Search ..... 101/383–384, 101/385, 389, 378, 379, 382, 415.1, 426

[56] References Cited

U.S. PATENT DOCUMENTS

| | | | |
|---|---|---|---|
| 1,966,121 | 7/1934 | Hotchkiss | 101/415.1 |
| 2,169,676 | 8/1939 | Buck et al. | 101/378 |
| 2,229,133 | 1/1941 | Sands | 101/383 |
| 2,579,517 | 12/1951 | Rowell et al. | 101/415.1 |
| 2,771,031 | 11/1956 | Knapp | 101/384 X |
| 3,128,700 | 4/1964 | Kunetka | 101/379 |
| 3,160,096 | 12/1964 | Norton | 101/415.1 X |
| 3,255,697 | 6/1966 | Cunningham | 101/383 X |
| 3,358,598 | 12/1967 | Middleton | 101/378 |
| 3,406,629 | 10/1968 | Hoexter | 101/415.1 |
| 4,380,956 | 4/1983 | Elworthy | 101/383 X |

FOREIGN PATENT DOCUMENTS

| | | | |
|---|---|---|---|
| 851841 | 10/1960 | United Kingdom | 101/378 |

*Primary Examiner*—E. H. Eickholt

*Attorney, Agent, or Firm*—Steele, Gould & Fried

[57] ABSTRACT

Individual blocks with the register elements provided on one of their sides are fitted to corresponding register pins on a strip-like mounting device and are optionally affixed with small double adhesive tape portions. The mounting device is then fitted to the printing roller, where it engages in bores with corresponding pin-like alignment means. The printing blocks are affixed in conventional manner with double adhesive tape and the mounting device is removed again. In other embodiments, the register elements can also comprise projections on the block and corresponding recesses on the mounting device.

7 Claims, 8 Drawing Figures

METHOD AND APPARATUS FOR DRAWING FLEXIBLE PRINTING BLOCKS ONTO PRINTING ROLLERS IN AN IN REGISTER MANNER

BACKGROUND OF THE INVENTION

The present invention relates to a method for drawing flexible printing blocks onto printing rollers in a registered manner, and to an apparatus for performing the method.

German Pat. No. 818,807 discloses an apparatus for accurately placing printing plates made from rubber or the like on plate mounting bases. Individual flexible blocks are fixed to a flexible packing sheet, by being positioned on a working plate with the aid of thumb-tack-like register pins. The packing sheets are then fixed to one side of the printing roller by means of screws and are adhered over their entire area.

Although this apparatus makes it possible to apply individual blocks in an in register manner with the aid of the auxiliary device, it requires the application of two layers (block and packing sheet) to the printing roller. In addition, the problem still exists of applying the packing sheet in registered manner to the printing roller, which must take place very accurately, particularly in the case of several successively operated printing rollers printing the same paper, e.g. for multicolour printing. Furthermore, considerable difficulties are encountered when replacing individual blocks, e.g. in the case of damage, but also when setting up, e.g. in the case of a too bold impression of an individual block. In addition, German Pat. No. 1,132,154, DAS 1,611,388 and DOS 2,256,952 disclose mounting devices, on which blocks are aligned in accordance with layer lines, measuring scales or register crosses and then applied to the printing roller. However, these mounting devices are very complicated mechanical precision devices, which make the complete installation expensive and can only be economically used in large printing works.

SUMMARY OF THE INVENTION

The object of the invention is to provide a method and apparatus enabling printing blocks to be very accurately adhered to the printing roller, permitting problem-free and accurate performance, particularly when changing blocks. According to the invention, this problem is solved by use of corresponding engaging elements on the blocks and a mounting device and positive alignment means between the mounting device and the printing roller.

Conventionally, for rotary printing with flexible blocks, several blocks in the form of flexible strips are juxtaposed on the printing roller and thereby embrace the entire periphery of the roller. However, since for manufacturing reasons, it is normally impossible to manufacture a block for the entire width of the printing roller, said blocks must be very accurately alinged in juxtaposed manner on the roller. Usually, at the time of block manufacture, on the edge areas, which are subsequently cut off the end product, register crosses or other marks are provided enabling several rollers to be aligned with one another. These register marks are preferably used for applying the printing blocks to a mounting device. In addition to the positive engagement resulting from the register marks, there can also be an adhesive connection, provided e.g. by small pieces of adhesive tape, which can subsequently be removed. Thus, the blocks are preferably applied to the mounting device by their printing side and are then brought onto the printing roller together with the mounting device, followed by in register alignment by positive engagement and pressing onto the printing roller, so that the double adhesive tape, which has previously been applied either to the blocks or to the printing roller, secures the said blocks. The mounting device is then removed from the printing roller, accompanied by the removal of any provisional adhesive connection between the mounting device and the foil. Thus, particularly precise registration is obtained, because there is a positive engagement both when applying the blocks to the mounting device, and when engaging the said device on the printing roller and this not only precisely fixes the blocks in the circumferential and transverse direction of the printing roller, but also in the angular alignment thereof.

The apparatus for performing the method comprises a mounting device and a corresponding construction on the printing roller, e.g. the provision of bores, which cooperate with the mounting device. The latter can be a simple ledge or strip, on whose one side are provided, together with alignment means, register elements in the form of a plurality of register projections or recesses, which cooperate with corresponding recesses or projections on the blocks. The alignment means are preferably pins projeting over the thickness of the block and which are removable from the other side, i.e. that pointing away from the printing roller in the fitted state. Thus, after adhering the blocks to the printing roller, it is possible to draw out the alignment means, so that the mounting device fixed by small "adhesive spots" to the blocks can be "peeled off" the same and need not be precisely radially removed, when all the adhesive spots would have to have been detached simultaneously.

In the case of a flexible relief printing block, the simplest construction of the register elements involves small cylindrical projections in two upper corners of the block, which preferably carry the register crosses, which engage in holes in the mounting device. However, it is also possible to provide crosslike projections or to use all other types of positive engaging elements. The construction of the register elements as holes is also very simple, if e.g. a projecting register mark is engaged with a punching device, centers the latter and consequently permits the cutting away of an in register hole.

It is advantageous if the alignment means contain pins on the mounting device and bores on the printing roller, because then there is no need to have any projecting parts on said roller.

Normally, a plurality of individual blocks are centered in juxtaposed manner on a printing roller. However, if in a special case a large block is to be individually fixed, the mounting method is just as advantageous. Thus, it is also suitable for the fitting of varyingly large blocks. It is then merely necessary to provide projections or recesses with a corresponding pattern on the mounting device, whereby it must be possible for there to be at least two register elements per block. Due to the very simple construction of the mounting device, it is also possible to provide different mounting devices for different block sizes or spacings. Moreover, e.g. in the case of very wide printing blocks, it is possible to construct the mounting device in such a way that it only e.g. receives the blocks for one half of the printing roller width. This leads to no significant impairment of the fitting precision. In this case, additional alignment means (bores) would be provided on the printing roller.

Although the construction of the printing roller as a ledge with register elements and alignment means which are constituted by different projections or recesses, is very simple and advantageous, it would also be possible to combine into one part the alignment means and register elements and/or to construct the mounting device in multipart manner.

BRIEF DESCRIPTION OF THE DRAWINGS

The invention is described in greater detail hereinafter relative to non-limitative embodiments shown in the drawings, wherein.

DETAILED DESCRIPTION OF THE PREFERRED EMBODIMENTS

Figure 1:
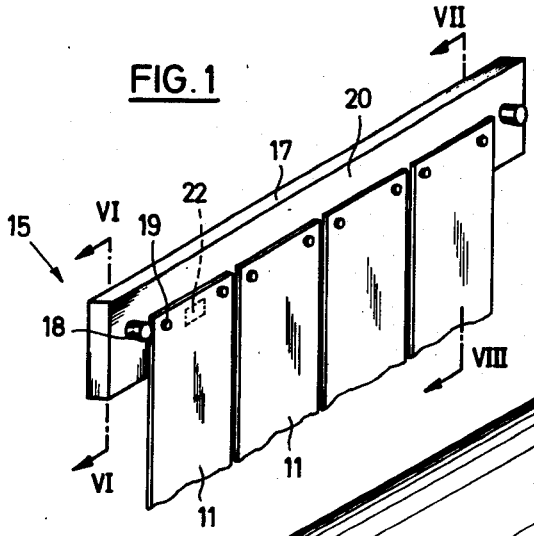
FIG. 1 is a perspective view of a mounting device with blocks fitted thereto.

FIG. 1 shows four printing blocks 11, on one of whose sides (that remote from the viewer in FIG. 1) are shaped the raised surfaces or characters 12 (FIG. 4) which produce the impression. For example, they can be so-called photopolymer blocks. The printing profile is produced photographically and the blocks are intended for rotary relief printing. For this purpose, they are applied to the printing roller 13 shown in FIG. 2 and in fact are conventionally stuck down by a double adhesive tape 14 (FIG. 3). Blocks 11 have a strip-like construction and pass either wholly or partly round the printing roller circumference. They are made from a flexible, rubbery plastics material.

The device for applying the blocks 11 to printing roller 13 comprises a mounting device 15 (FIG. 1) and alignment means 16 in the form of cylindrical holes, which are drilled in the outer edge areas of the cylindrical printing roller shell and are located on a generatrix of the shell, i.e. on an axially parallel line.

Mounting device 15 comprises a ledge or strip 17 which, in the vicinity of its two outer ends, also have alignment means 18 in the form of pins projecting over one flat side of the strip. In addition, on said front flat side 20 of the strip, there are register elements 19 in the form of pins which, in the represented embodiment, are so inserted in corresponding, in register bores 21 or corresponding bushes, that they can be longitudinally displaced. The pin-like register elements 19 are somewhat longer than the thickness of strip 17 and block 11, plus the thickness of the double adhesive tapes.

Figure 2:
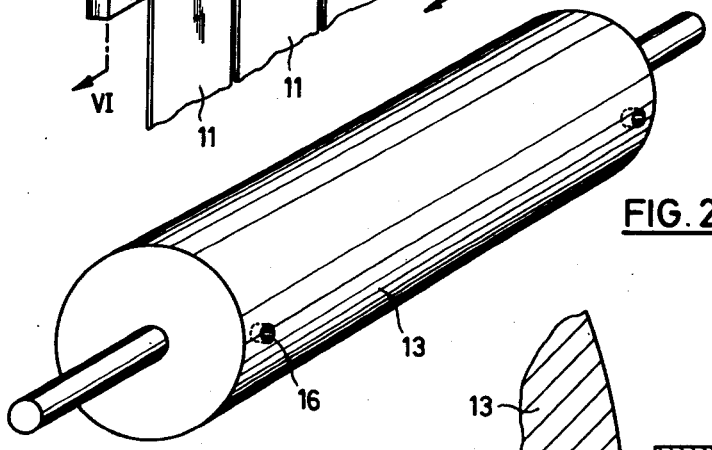
FIG. 2 is a perspective view of an associated printing roller.
Figure 3:
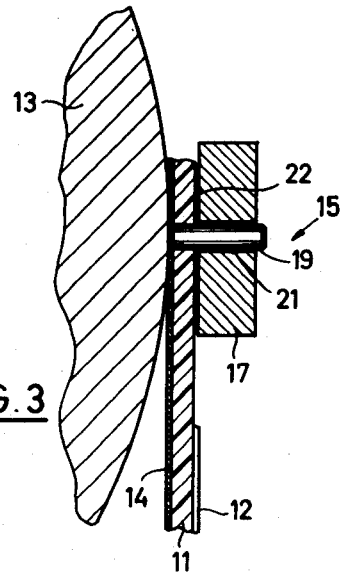
FIG. 3 is a section along line VII–VIII of the construction of FIG. 1.
Figure 4:
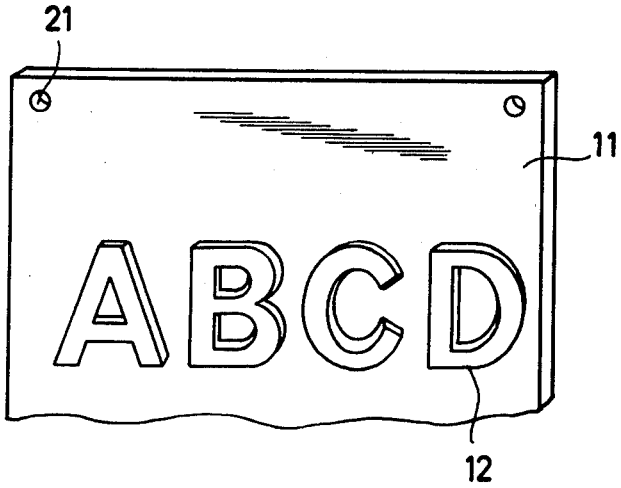
FIGS. 4 to 6 are perspectie partial views of different blocks.

For preparing the blocks for fitting to the printing roller, the individual blocks 11 with their register marks 21, which in the embodiment of FIGS. 2 to 4 are constituted by holes in two corners of the block, are successively drawn onto the pin-like register elements 19, which is particularly simple because pins 19 project somewhat further over side 20 of strip 17, than corresponds to the block thickness. Thus, the blocks are positioned in juxtaposed manner on the mounting device in an accurate manner corresponding to the subsequent desired alignment on the printing roller, with the side carrying the printing image 12 facing the mounting device 15. The double adhesive tape 14 can be applied to the side directed towards the observer in FIG. 1.

The mounting device is then applied to the printing roller in reversed alignment, i.e. with the side visible in FIG. 1 turned towards said roller, and the pin-like alignment means 18 are introduced into the corresponing alignment means 16 constituted by holes. As pins 18 project further than the block thickness, this alignment can take place without there being any adhesive connection between the printing roller and the block. Only when the mounting device 15 is accurately positioned relative to the printing roller, is it pressed onto the latter. As can be gathered from FIG. 3, the pin-like register elements then move back somewhat, so that the block is pressed entirely onto the roller and can now be stuck down in a registered manner.

In order to fix the blocks more securely to the mounting device, so that it is not necessary for the register elements alone to take up the forces occurring when manipulating the mounting device, the block can be fixed to strip 17 by small double adhesive tape portions 22.

In the embodiment of FIG. 1, the mounting device must be drawn off in parallel when removed from the printing roller, so that the pins 18 do not tilt in bores 16.

Figure 7:
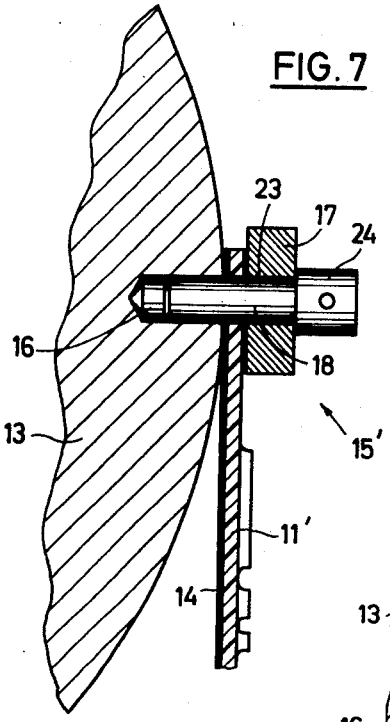
FIGS. 7 and 8 are details of the apparatus in two different phases of the process, namely VI—VI and VII—VIII in FIG. 1 (but which shows a different embodiment).
Figure 8:
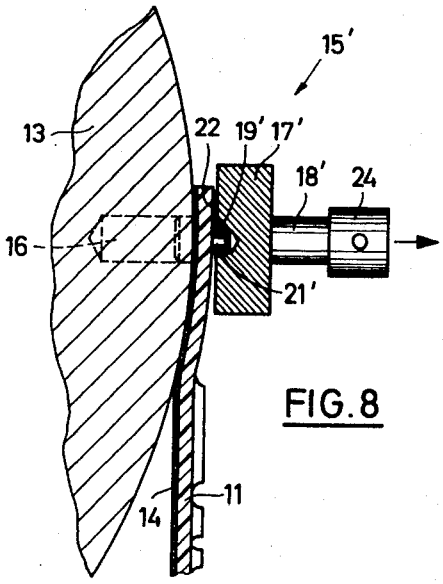

In the embodiment of FIGS. 7 and 8, this removal is facilitated in that the alignment means 18' are removably inserted in corresponding bores or bushes 23 in strip 17' of the mounting device. A head 24 positions them in their fitting positions, in which the alignment means project above the side 20 pointing towards the printing roller in the fitted state.

In this position, the modified mounting device 15' according to FIGS. 7 and 8 is mounted on printing roller 13 (FIG. 7) and securely adheres blocks 11'. The pin-like alignment means 18' are then drawn apart to such an extent that they become free from holes 16 (FIG. 8), so that mounting device 15' is no longer direclty connected in positively engaged manner with the printing roller. There is consequently no need for the mounting device to be drawn off parallel radially from the printing roller and it can instead be raised at one end, so that the double adhesive tape portions 22 can be successively detached and "peeled off".

A block, partly shown in FIG. 4, is used in FIG. 3. In its two upper ends, it has register marks 21 in the form of holes arranged in a registered manner and which are produced with a hand-feed punch, which is centered on the register marks, which are photochemically produced during block production, together with the printed image, i.e. are accurately aligned with the latter. The register marks according to FIG. 4 produce no impression during the following printing press and are consequently particularly suitable for blocks, which are used for printing continuous webs, where no edge waste is cut off at specific points.

Figure 5:
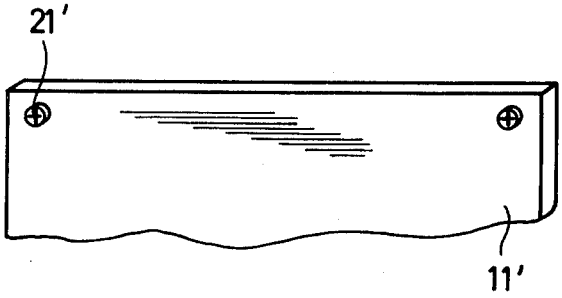

FIG. 5 shows a block 11', in which the aforementioned positive register marks 21' produced during block production project in raised manner and are provided with an additional, cross-like marking. In mounting device 15', they can directly engage in corresponding register elements 19' in the form of bores and consequently fix the block 11' in positively engaged, in register manner on mounting device 15'. During subsequent printing, said register marks produce a register cross on the printed sheet and this can be used for aligning successively operated printing rollers, printing the same paper, e.g. in multicolour printing.

It is a particular advantage of the method and mounting device according to the invention, that the alignment, although it takes place by an intermediate means, namely the mounting device, can take place so accurately by double precise, positive-engagement (block-/mounting device and mounting device/printing roller) that necessarily the correct positioning of the blocks on the printing rollers takes place, as a result of the register marks produced with maximum accuracy during block manufacture. This also applies to the blocks of successively operated, different printing rollers, so that there are no problems when setting up for multicolour printing.

Figure 6:
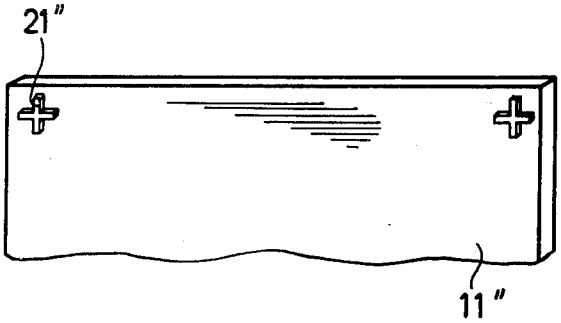

The embodiment of block 11'' according to FIG. 6 has register elements 21'' in the form of raised crosses. In this case, a corresponding mounting device would have two crossing slots as the register elements. Numerous further embodiments of such register elements are possible.

In the embodiment of FIG. 3 with displaceable register elements 19, the latter could be constructed in such a way that they are cushioned in the direction of side 20, so that they can be forced back when engaged on the printing roller, but on removing the mounting device therefrom they spring outwards again. However, since normally ledge 17 is placed on a smooth table for fitting the blocks, the pins 19 are automatically forced out again in the case of the embodiment of FIG. 3. The construction which the register elements on the block are constituted by holes, is particularly advantageous because the holes can be produced with a precisely cylindrical wall, whereas normally the raised register marks produced during block manufacture have a somewhat conical lateral face, which could make the a registered application to the mounting device more difficult. However, the slightly conical construction of the register marks is particularly suitable for centering corresponding punches for holes.

In the represented embodiment, the blocks are shown with in each case two register elements in the two corners. However, more register elements can be provided in the case of larger blocks. It is also possible to arrange the register elements on the mounting device with uniform spacings, so that blocks with different sizes can be mounted with the same mounting device. However, it is also possible to provide different mounting devices for the same printing roller, which have a different nature and/or spacing of the register elements 19, 19'.

What is claimed is:

1. A method for drawing a pluraltiy of flexible printing blocks onto a printing roller in a registered manner, the blocks having register marks, comprising the steps of:

positively engaging one edge of the blocks by fitting at least one mounting device to the blocks;

fitting the blocks and mounting device to the printing roller in a registered manner by positively engaging the at least one mounting device in a corresponding alignment means;

fixing the blocks to the printing roller; and, removing the at least one mounting device.

2. The method of claim 1, further comprising the step of adhesively fitting the at least one mounting device to the blocks.

3. The method of claim 1, further comprising the step of fitting the at least one mounting device to the printing side of the blocks.

4. The method of claim 1, comprising the step of adhesively fixing the blocks to the printing roller.

5. The method of claim 1, further comprising the step of at least partially incorporating the alignment means into the printing roller.

6. The method of claim 1, further comprising the step of fitting the blocks to the at least one mounting device by pins slideably mounted through the at least one mounting device.

7. The method of claim 1, further comprising the step of aligning the at least one mounting device with the printing roller by pins projecting from the at least one mounting device and corresponding bores formed in the printing roller.

* * * * *

UNITED STATES PATENT AND TRADEMARK OFFICE

CERTIFICATE OF CORRECTION

PATENT NO. : 4,467,722

DATED : August 28, 1984

INVENTOR(S) : KLINGELHOEFER ET AL

It is certified that error appears in the above-identified patent and that said Letters Patent is hereby corrected as shown below:

Column 1, line 24, insert --a-- before "registered".

Column 3, line 21, "perspectie" should be --perspective--.

Signed and Sealed this

*Thirtieth* Day of *July 1985*

[SEAL]

*Attest:*

DONALD J. QUIGG

*Attesting Officer* *Acting Commissioner of Patents and Trademarks*